US005573126A

United States Patent [19]

Beauclerc et al.

[11] Patent Number: 5,573,126

[45] Date of Patent: Nov. 12, 1996

[54] GRAVITY WEDGE FOR A SLACKLESS RAILCAR CONNECTOR ASSEMBLY

[75] Inventors: Richard G. Beauclerc, Seven Hills, Australia; Charles P. Spencer, Staunton, Ill.; Franklin S. McKeown, Jr., St. Louis, Mo.

[73] Assignee: Amsted Industries Incorporated, Chicago, Ill.

[21] Appl. No.: 627,802

[22] Filed: Apr. 10, 1996

Related U.S. Application Data

[63] Continuation of Ser. No. 333,429, Nov. 2, 1994, abandoned.

[51] Int. Cl.[6] ..... B61G 9/00; F16F 7/00

[52] U.S. Cl. ..... 213/62 R; 213/64; 213/75 R; 267/141

[58] Field of Search ..... 213/50, 59, 61, 213/62 R, 64, 75 R; 267/140, 141, 141.1; 105/4.1

[56] References Cited

U.S. PATENT DOCUMENTS

| | | | |
|---|---|---|---|
| 2,815,865 | 12/1957 | Pelikan | 213/61 |
| 3,396,673 | 8/1968 | Livelsberger et al. | 213/75 R |
| 3,716,146 | 2/1973 | Altherr | 213/75 R |
| 3,834,513 | 9/1974 | Miura et al. | 267/141 X |
| 4,054,291 | 10/1977 | Maeda | 267/141 X |
| 4,258,628 | 3/1981 | Altherr | 213/75 R X |
| 4,456,133 | 6/1984 | Altherr et al. | 213/62 R |
| 5,115,926 | 5/1992 | Kaufhold | 213/50 |
| 5,133,467 | 7/1992 | Hawthorne et al. | 213/59 |
| 5,193,699 | 3/1993 | Kaufhold et al. | 213/75 R |
| 5,246,135 | 9/1993 | Radwill | 213/64 |
| 5,312,007 | 5/1994 | Kaufhold et al. | 213/75 R |

*Primary Examiner*—Robert J. Oberleitner
*Assistant Examiner*—Kevin D. Rutherford
*Attorney, Agent, or Firm*—Edward J. Brosius; F. S. Gregorczyk; Stephen J. Manich

[57] ABSTRACT

When slack-free railcar connector assemblies are placed under very high tensile loading, the connector assembly components will stretch and allow a typical "rigid" gravity wedge to descend into a fully seated position between the components and lock-in the tensile loads. The locked-in loads become additive in nature when successively encountered compressive loads are experienced by the connector assembly, thereby increasing the lateral drawbar angling forces, as well as accelerating coupling component wear. The wedge component of the present invention includes a means for vertically supporting and retaining the wedge in a holding position slightly above the normally fully seated position during the tensile loading, thereby eliminating the build up of tensile forces in the connector assembly.

8 Claims, 3 Drawing Sheets

GRAVITY WEDGE FOR A SLACKLESS RAILCAR CONNECTOR ASSEMBLY

This is a continuation of application Ser. No. 08/333,429 filed on Nov. 2, 1994 now abandoned.

BACKGROUND OF THE INVENTION

1. Field of the Invention

The present invention generally relates to railcar connector assemblies, and more particularly to an improved arrangement for a slackless railcar connector assembly in which the gravity wedge is prevented from fully seating during very high tensile buff loading on the connector. Prevention of the wedge from fully seating will eliminate the wedge from storing the tensile forces within the assembly, which said stored forces act as additive forces to later experienced compressive loads acting on the connector assembly.

2. Discussion of the Prior Art

Railway cars are connected together generally by connector assemblies, namely articulated connectors, drawbars, or E or F type couplers. Two mating ends of a coupler on two successive railcars are joined together, while the respective opposite ends of the coupler extend into the center sill on each respective railcar, wherein they are each secured by a pin or key means for transmitting longitudinal loads into the railcar center sill.

One type of slackless connector assembly which features a drawbar positioned and held within a center sill is shown in Kaufhold U.S. Pat. No. 5,115,926, wherein a "rigid" gravity-actuated wedge is used to maintain a slack-free connection within the connector assembly. When component wear occurs on the various elements comprising the connector assembly system, increased longitudinal clearances develop between the follower block and pocket casting, and this clearance or slack is constantly being taken-up by the action of the dropping rigid wedge.

Recent laboratory tests have indicated that stretching in the car body structure and/or the surrounding connector components due to heavy draft tension loads will also create a temporary space or slack between the follower block and the pocket casting, into which the rigid wedge will drop. When the high tension loads are released, most of the loads will be stored within the connector assembly due to the rigid wedge dropping, and then locking the components in place. A subsequent buff load (compressive type load) will be additive to the forces already locked into the assembly, thereby imparting unanticipated longitudinal loads at the follower block and connector end interface. These additional and unanticipated loads will induce higher lateral drawbar angling forces, as well as accelerated component wear.

SUMMARY OF THE INVENTION

Accordingly, it is a principal object of the present invention to provide an improved slackless railcar connector assembly that will prevent tensile loads from being stored within the connector assembly after the railcar has been placed under a heavy draft or tensile load.

Another object of the present invention is to provide an improved slackless railcar connector assembly which will eliminate tensile pre-loading, and be capable of receiving the full buff load experienced by the train, yet still adjust to the increased clearances created when the system wears.

Yet another object of the present invention is to provide an improved gravity wedge which has a resilient means for supporting or holding the wedge in a vertical direction during tensile loads so that the wedge will not drop into a fully seated position during the period of the applied tensile loading.

Basically, the present invention includes a "floatable" wedge which has a resilient means attached thereon, and which protrudes slightly beyond one or both faces of the wedge so that a small, but controlled gap symmetrically remains between the wedge face(s) and the adjacent surface(s). When railcar tensile loads are released, the only locked-in force operating on the connector assembly will be that dictated by the compressive load rate of the resilient means. The resilient means has a load rate large enough to maintain the controlled gap even after the tensile load has been released. The improved wedge will operate in buff exactly like prior art "rigid" wedges and when the buff or compressive load has been released, the wedge will maintain its vertical position as the resilient means "feeds out" and holds the wedge in place, until the next-experienced tensile loading.

BRIEF DESCRIPTION OF THE DRAWINGS

Further objects and advantages of the present invention will become apparent upon reading the following detailed description in conjunction with the drawings wherein.

DETAILED DESCRIPTION OF THE PREFERRED EMBODIMENTS

Figure 1:
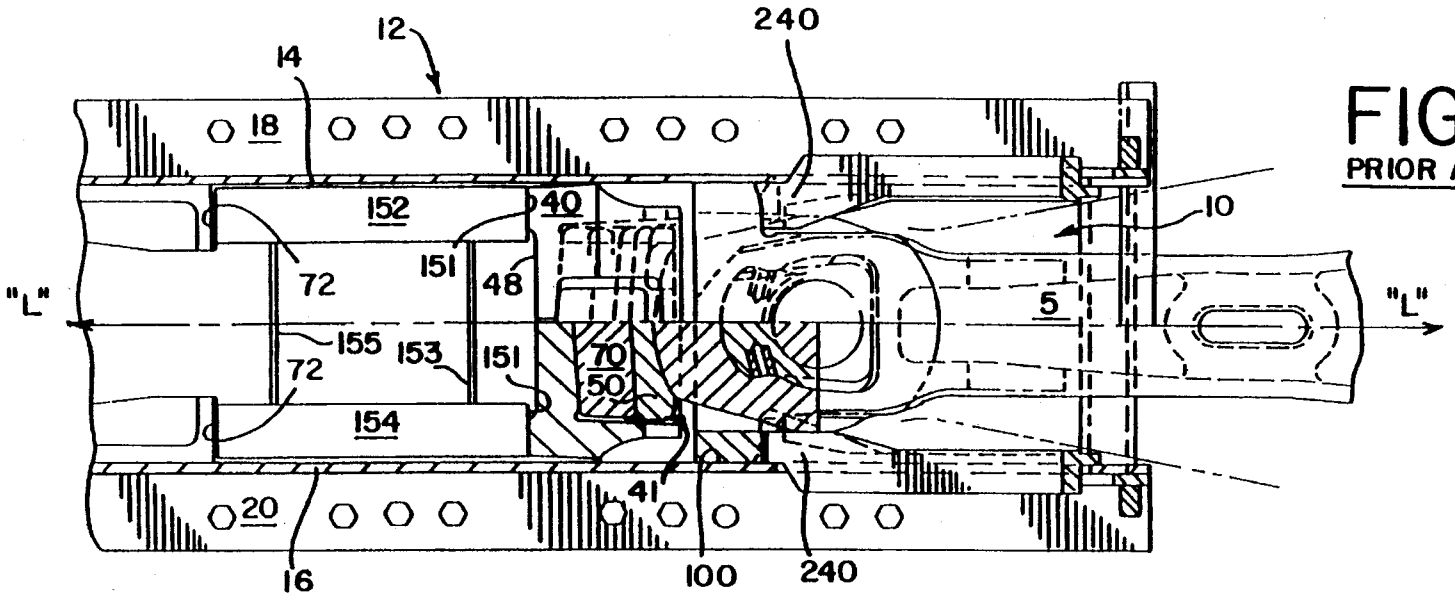
FIG. 1 PRIOR ART
FIG. 1 is a top view of a prior an slack-less connector assembly.
Figure 2:
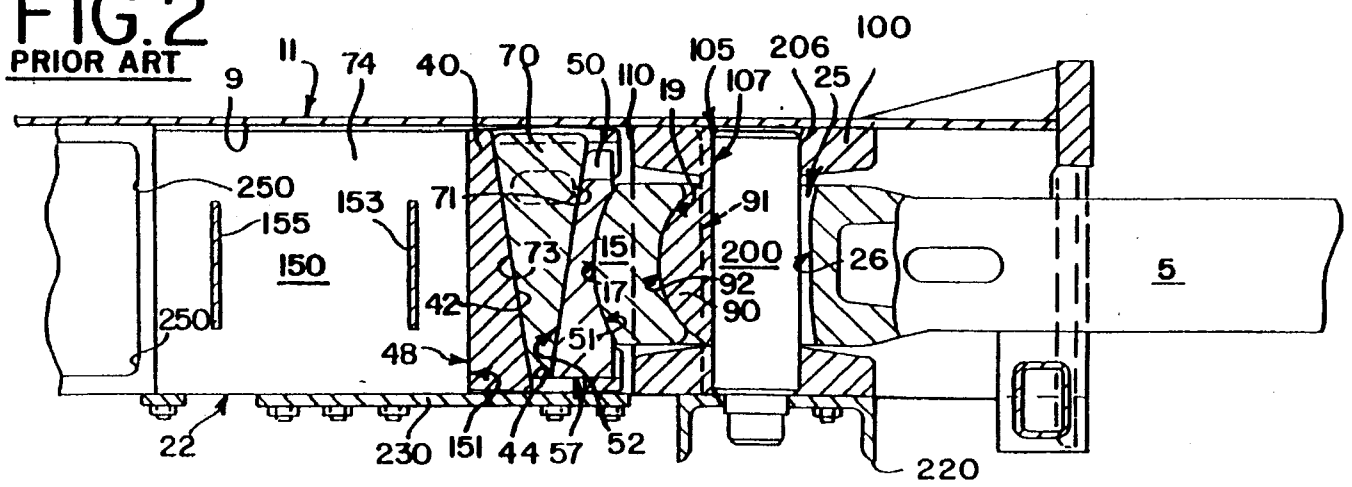
FIG. 2 PRIOR ART
FIG. 2 is a partial cross-sectional side view of the assembly of FIG. 1.

Referring now to FIGS. 1 and 2, railcar connector assemblies 10 are usually anchored within and project outwardly from a railcar center sill, generally shown at 12, in order to couple ends of a railcar together. While there are several types of connectors applicable to the present invention, such as articulated connectors, E and F type couplers, and drawbars (including rotary drawbars), the illustrated preferred embodiment of the present invention will be described using a drawbar. In FIG. 1, it is to be understood that the longitudinal axis "L" of the center sill 12, which is secured beneath the railcar, coincides with a longitudinal axis of the railcar. The center sill 12 is of standard construction comprising an inverted U-shaped channel member having a top wall 11, sidewalls 14 and 16, and out-mined flanges 18 and 20 at the lower, open bottom 22 of the inverted U-shaped sill. A drawbar illustrated at 5 has a butt end 15 with an outer convex surface 17, an inner concave surface 19, and an opening or pin hole 25 extending through and normal to the longitudinal axis of the center sill for receiving a connecting pin 200. Opening 25 is formed by a continuously curved concave inner surface 26. Pin 200 is an elongate, vertically disposed bar which indirectly couples the drawbar to the center sill, having a cylindrical edge surface 206 in mated engagement with cylindrical surface 107 of opening 105 in short yoke casting 100. The short yoke casting 100 is held within the sill 12 by channel member 220 and rests against center sill from stops 240. A pin bearing block 90 has a concave cylindrical from surface 91 that abuts rear convex edge surface 206 on pin 200, as well as an outward convex back surface 92 abutting inner concave surface 19 on drawbar butt end 15.

Pocket casting 40 fits within the car center sill 12 at a predetermined longitudinal spacing from the back wall 110 of unitary short yoke casting 100 and is held within the sill by support bracket 230. Pocket casting 40 has a generally flat, but sloped interior rear wall 42, a bottom interior surface 44 and an exterior rear wall surface 48 which abuts the front face 151 of either a spacer block 150 or the rear stops 250 of the center sill. A follower block 50 is located within pocket casting 40 and has a concave front surface 51 that abuts outer convex curved surface 17 of drawbar butt end 15. The follower block 50 also has a rear surface 52 in contact with gravity wedge 70 and a bottom surface 57 resting on bottom surface 44 of pocket casting 40 to keep concave from surface 51 symmetrical with pin hole 25 of drawbar 5.

Gravity wedge 70 has a generally flat front wall 71 that abuts generally flat rear surface 52 of follower block 50 and also has a generally flat back wall 73 that abuts with interior wall 42 of pocket casting 442). The center sill sidewalls 14, 16, are provided with access slots (not shown) which allow the wedge 70 to be held up for installation purposes. Rear outside wall surface 48 of pocket casting 40 bears against the front face 151 of spacer 150 or center sill rear stops 250 if a spacer block is not used. Spacer block member 150 is a fabricated rectangular housing which includes a rigid frame that is capable of withstanding the impact loads imparted upon the center sill. Spacer block 150 consists of two substantial vertical plates 152,154 equal in length and held in a spaced, parallel relationship from each other by cross plate members 153 and 155. Vertical plate members 152, 154 project upwardly from the open bottom 22 of center sill 12 to abut inside surface 9 of center sill top wall 11. Cross plate members 153, 155 are not of substantial strength and are vertically centered between the height of spacer block member 150. Spacer block 150 typically replaces the yoke and draft member (not shown) which are commonly used when a standard coupler arrangement is connected within the center sill. If a spacer member is not used, the pocket casting 40 is typically cast as one long member such that the pocket casting in effect, contains a built-in spacer block so that the pocket casting rear wall surface 48 abuts the center sill rear stops 250. Due to dimensional irregularities in cast members, it is more typical to use a standard pocket casting member 40 along with a fabricated spacer member 150.

Operationally, when the connector assembly 10 experiences a compressive or buff load, drawbar 5 will be pushed along the longitudinal axis towards rear stops 250. Short yoke 100, being pinned to butt end 15, will move backwards in the same direction, but only by the minute distance which cumulatively represents the mount of free slack between the remaining connector assembly components. As seen from viewing FIG. 2, butt end 15 pushes follower block 50 directly against rigid gravity wedge 70, wherein the forces are then transferred from the wedge into the pocket casting 40. Since pocket casting 40 is indirectly abutting rear stops 250, the compressive forces will be transferred directly into the spacer block, and then into the rear stops, before eventually being transferred into each of the center sill sidewalls 14, 16. Likewise, when a tensile or draft load is experienced by the connector assembly, drawbar 5 will be pulled in a longitudinal direction such that butt end 15 will move toward from stops 240. Since the drawbar is connected to pin 200 and therefore, short yoke 100, forces will be transmitted from the drawbar, into the short yoke, and then into front stops 240, where they are eventually distributed into the center sill sidewalls 14,16. Upon pulling movement of the drawbar bun end 15, it is appreciated that a small gap will appear between the butt end 15 and follower block 50, causing rigid gravity wedge 70 to descend into pocket casting 40, thereby removing the slack or gap created between the butt end 15 and follower block 50. Under very heavy tensile loading, it can be appreciated from the above operational description that wedge 70 will downwardly descend and remove the artificially created free slack which occurs in the connector assembly when the components are stretched by the pulling action.

According to the present invention shown in FIGS. 3–6, a "floating" gravity wedge 70 is incorporated into the connector assembly 10 wherein the wedge is provided with an attached set of supporting means 60 for vertically supporting and holding the wedge in a position slightly above a fully seated position when the connector assembly is under tensile or draft loads. It should be made clear that all connector assembly components of the present invention will be referenced using the same numerals as the prior an system, including the gravity wedge. As previously described, a prior an "rigid" wedge 70 will have a natural tendency to drop by gravity within the pocket casting 40 when the drawbar butt end 15 is pulled along the longitudinal axis during tensile, draft loading. As described, the connector assembly components will separate or stretch, allowing the wedge to fall into the slack or space created upon stretching. This dropped position is considered a fast seated position. While in the fast seated position, the weight of the wedge will cause front wall 71 and back wall 73 to respectively push against surfaces 52 and 42 and take-up the available free slack between the connector components. However, removing the free slack while the railcar is being pulled and under tensile loading is not desirable because a rigid gravity wedge will remain in this fast seated position and "lock-in" most of the tensile loads applied to the connector through the seating action. The locked-in forces are additive in nature to compressive loads that are later experienced when the thin is being pushed and under compressive loading. Detrimentally, the additive forces accelerate component wear and create higher lateral drawbar angling forces which may contribute to wheel lift.

The present invention on the other hand, prevents the wedge from falling into the first seated position during tensile loading because the supporting means 60 which is provided in the front and back walls 71 and 73 of the wedge, symmetrically maintains the wedge in a holding position slightly above the fast fully seated position. As the FIGS. 3–6 show, the means 60 is resilient and protrudes slightly beyond the walls 71,73 of the wedge so that a small amount of controlled gap, herein designated as "X", remains between the wedge walls and the adjacent surfaces. In this case, the adjacent surfaces will be the follower block rear surface wall 52, and the pocket casting rear sloped wall 42 and it is preferable that the controlled gap "X" be about 0.125 inches.

Figure 3:
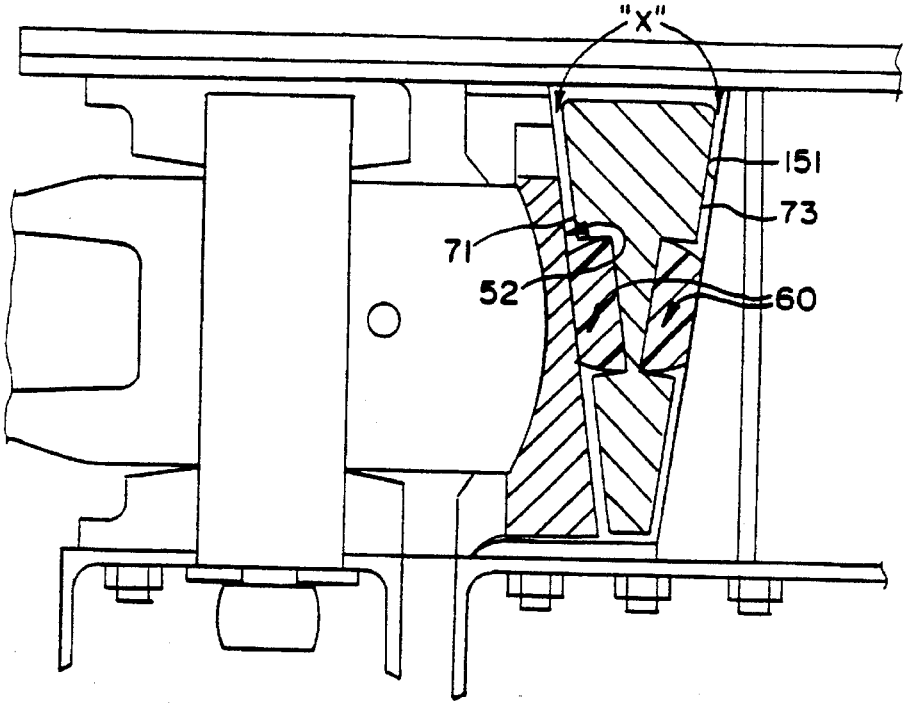
FIG. 3 is a cross-sectional side view of the connector assembly of the present invention with supporting means attached to the gravity wedge.
Figure 4:
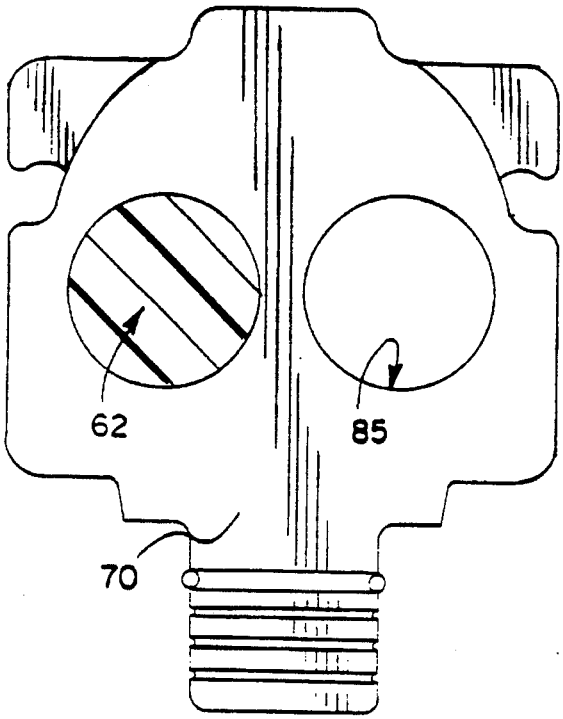
FIG. 4 is a front view of a gravity wedge of the present invention.
Figure 4A:
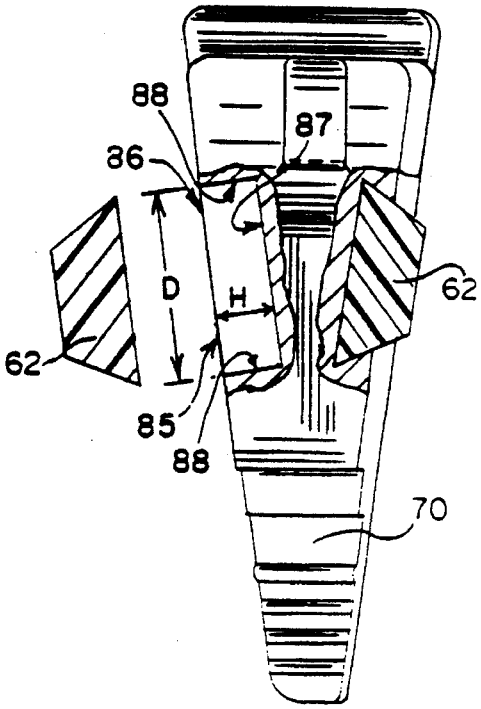
FIG. 4A is a more detailed side view of the present invention shown in FIG. 3.
Figure 5:
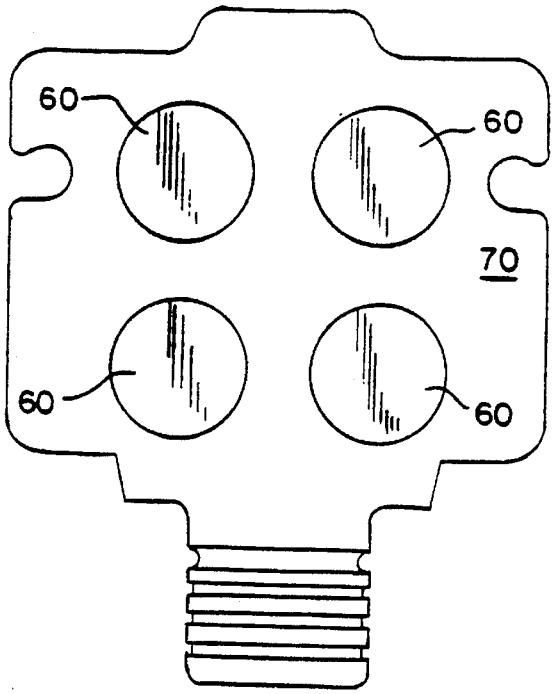
FIG. 5 is a front view of a gravity wedge incorporating multiple supporting means.
Figure 6:
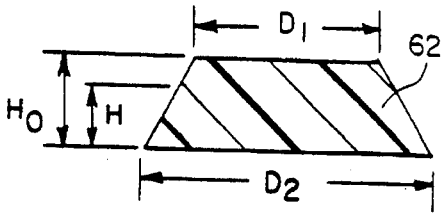
FIG. 6 is a side view of an elastomeric spring used as the preferred supporting means of the present invention.

FIG. 3 shows that the wedge can be provided with a single supporting means on each of the front and back walls, or it can comprise multiple supporting means on both walls. For example, FIGS. 4 and 5 show that the multiple supporting means could consist of two horizontally or two vertically aligned and spaced means, or it can consist of more complicated multiple sets of means like that of FIG. 5, where the wedge is shown as having four supporting means 60 on each front and back wall 71,73. The actual size, location, and the number of supporting means used for supporting wedge 70 is not crucial to the operation of the invention as long as the supporting means has the capability to keep the wedge from fully seating and relatively square within the pocket casting during tensile loading. It is envisioned that the supporting means 60 of the preferred embodiment be comprised of an elastomeric material having spring-like characteristics. For example, FIG. 4A shows wedge 70 incorporating an elastomeric spring means 62 operably functioning as each supporting means 60, wherein each elastomeric means 62 is received into a blind bore 85, which is formed on each wall of wedge 70. The bores 85 can either be cast as pan of the wedge or later machined into it. Each blind bore has a bore inlet 86, bore sidewalls 88, and a bore base 87. The depth of each bore is interrelated to the compression characteristics of the chosen supporting means 60, which in this case, is a function of the compressibility of the elastomeric supporting spring 62. This is best understood by referring to FIGS. 4A and 6, where "D" is the diameter of bore 85 if a round hole is used, and "H" is the bore depth, with the compressed state of the elastomeric means 62 of FIG. 6 being a function of the bore volume "V", described by the formula $V=3.141(D/2)^2H$. As FIG. 6 illustrates, the elastomeric supporting means 62 has a compressed height equal to the depth "H" of blind bore 85, and an uncompressed height of $H_0$, where the distance determined by $H—H_0$ should be equal to X", or the amount of the desired controlled gap, which is preferably 0.125 inches. It should be understood that the shape of elastomeric supporting spring means 62 is more a function of the bore volume "V", meaning that elastomeric supporting means 62 does not have to be limited to strictly cylindrically-shaped forms. FIG. 6 illustrates this point where spring means 62 is shown having a base diameter of "$D_2$", which is equal to bore diameter "D", and an upper diameter of "$D_1$", which is less than the diameter of "$D_2$" to the extent that when the elastomeric spring means 62 is fully compressed from height "$H_0$" to height "H", the bore hole volume "V" will almost be completely filled by the elastomeric material bulging or expanding during compression.

Besides the unlimited profile choices available, it is also envisioned that the elastomeric supporting means 62 can be secured within blind bore 85 through a number of different ways. For example, means 62 could be secured to base 87 by bonding, or it could be "press" fired into the bore 85 with the body of spring means 62 being tightly secured between sidewalls 88, or it even could be secured by using a peg on the base of the supporting means which engages a complementary hole formed within bore base 87. In any event, once elastomeric supporting spring 62 is so attached, it will extend outwardly beyond each wedge wall 71,73 in its uncompressed state by the desired controlled gap "X" and be at least partially complementary in shape to that of blind bore 85.

The supporting means of the present invention must also exhibit characteristics which allow the wedge to fully withstand buff and shear loading experienced by the supporting means and yet still have the capability of adjusting to the increased clearances (slack) created within the connector assembly as the system wears. Therefore, it is preferable that the elastomeric supporting means be comprised of material exhibiting a compressive load rate between about 100,000 and 200,000 pounds per inch for installed pieces loaded in parallel. With these rates, it is preferable that a minimum of two supporting means 62 and a maximum of four means per side of wedge 70 be provided in order to prevent cocking or misalignment of the wedge through added stability. It is also desirable that the lateral shear rate of the elastomeric material be relatively high, say between about 75,000 and 150,000 pounds per inch in order to prevent significant shear deformation when protruding beyond the wedge face by the amount of the controlled gap "X" . It is also desirable that the material exhibit a value of about 40 to 60 in durometer when using the Shore D scale at a temperature of 70° F. This necessarily means that the elastomeric material must also be sufficiently resilient at –40° F. in order to follow a compression and release deformation through about 15% of its free or uncompressed height "H", at a cycling rate of about 5 hertz. It is also preferable that the chosen elastomeric material have a coefficient of friction between about 0.3 and 0.5 as between the elastomeric material and the adjacent cast steel surfaces. With these characteristics, each elastomeric spring will fully compress and not extend beyond wedge walls 71,73 at low magnitude loads, say as low as 20,000 pounds, or at high loads, say as high as 40,000 pounds. Under the fully compressed condition, the wedge 70 will operationally be equivalent to a "rigid" wedge device wherein the wedge can again resume a fully seated position. However, is to be understood that this second fully seated position is equivalent to the first fully seated position, except that the wedge and connector assembly components are now under compressive buff loading where the entire loading experienced by the follower block 50 will be transferred into the wedge, and then finally into the pocket casting 40. Under buff loading, the elastomeric material comprising the supporting means must also have characteristics which make the wedge capable of withstanding high compressive loads without settling of the material once the load is released. Settling is a condition where the elastomeric spring will lose the ability to fully return to its original freestanding position, in this case "$H_0$", after undergoing several tensile and compressive cycles. This means that when a buff load is released, the resilient supporting means should have the capability to "feed out" to the original holding position such that wedge 70 is again retained in a vertical position slightly above the first fully seated position. The wedge will remain in this holding position until the connector assembly again experiences its next buff or compressive load, thereby eliminating the possibility of the wedge dropping into the first seated position and storing tensile forces within the connector assembly.

Figure 7:
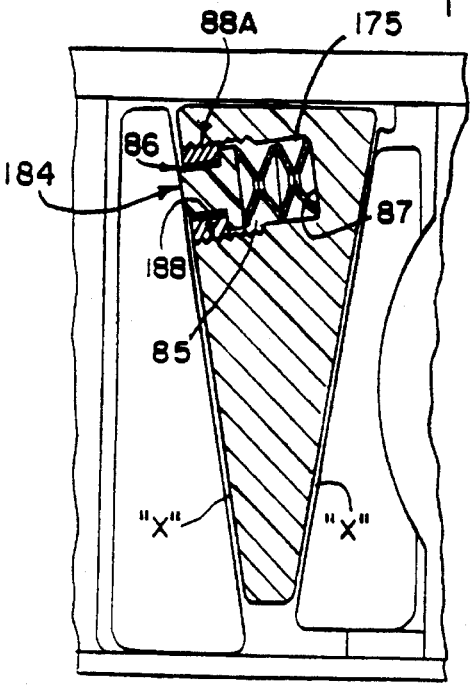
FIG. 7 is a cross sectional view of the present invention with the supporting means comprising a spring-loaded plunger assembly featuring stacked, belleville washers.
Figure 7A:
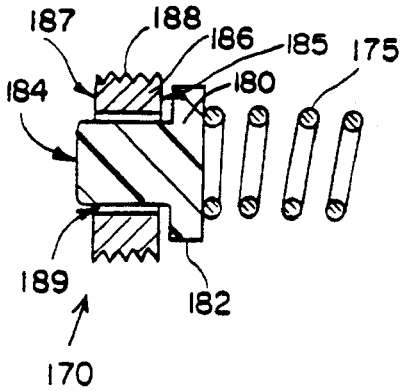
FIG. 7*a* is a detailed view of the plunger assembly of FIG. 7 using a helical spring.

FIGS. 7 and 7A shows a second embodiment of the present invention, wherein the supporting means 60 is comprised of a spring-loaded device or plunger assembly 170 instead of the resilient elastomeric supporting means. As the two figures show, the spring-loaded plunger supporting means 170 is comprised of a steel spring 175, either in the form of stacked Belleville washers, or as a single helical coil steel spring, a plunger keep 186 having a centrally located orifice 189, and a plunger 180 that is in intimate contact with steel spring 175. For the sake of discussing this particular embodiment, reference to "steel" spring should be understood to encompass either type of spring shown in FIG. 7 or FIG. 7A. In either case, action of the steel spring causes plunger tip 184 to project through orifice 189 for supporting contact with either rear follower block surface 52 or sloped interior wall 42 of pocket casting 40, depending upon which side of wedge 70 each spring-loaded plunger assembly is positioned. The plunger keep 186 has a generally geometric shape which is complementary to the geometric shape of each of the blind bores 85 and includes a periphery 187 having matched threads 188 to those threads 88A machined into the sidewalls 88 of blind bores 85. It should be understood that threads 88A are to be provided only at the bore inlet area 86, and are not to extend completely to bore base 87. Plunger keep 186 functions as a means for holding spring assembly 170 within bores 85 when the keep is threaded into each of the bore inlets 86. FIG. 7 illustrates that each bore base 87 will support the steel spring 175, with the spring extending upwardly towards bore inlet 86 until it contacts bottom surface 185 of plunger keep 186. The steel spring 175 is sized such that there is very little tolerance between the bore sidewalls 88 and the spring, thereby avoiding the need to permanently secure and prevent the spring from moving within the bore. It is also envisioned that with either type of steel spring, more than one spring will be required in order to maintain wedge 70 in the holding position. As FIG. 7 shows, several Belleville washers have been stacked within bore 85 as a means of achieving a high enough spring rate for holding the wedge. Alternative methods could include adding several bore and plunger assemblies to each wall of the wedge; this method would be especially well suited for the helical coil situation.

Plunger tip 184 has a peripheral shoulder 182 that is upwardly projected into abutting contact with plunger keep bottom surface 185 through the action of spring 175. As plunger keep 186 is threaded downwardly into bore 85, bottom surface 185 will contact and push shoulder 182 downward onto spring 175, thereby compressing the spring and causing plunger tip 184 to lower itself through orifice 189 and retract further into the blind bore 85. In this way, the controlled gap "X" between wedge 70 and the follower and pocket casting surfaces 52,42, respectively, can be adjusted by threading plunger keep 186 either inwardly or outwardly within blind bore 85. Plunger tip 184 is preferably comprised of a solid piece of elastomeric material having a dimensional size and complementary shape to orifice 189 at its upper portion, while the shoulder 182 is slightly smaller in dimensional size to bore 85. Like the elastomeric supporting means of the preferred embodiment, the elastomeric plunger tip 184 of this embodiment will fully compress within bore 85 whenever a compressive or buff load is experienced, and when that load is released, each plunger tip 184 will support and maintain wedge 70 in the holding position by action of spring 175 pushing plunger 180 outward of bore 85. It is also preferable that plunger tip 184 exhibit the same compression and shear loading strengths, as well as the same durometer and coefficient of friction properties of the elastomeric material of the preferred embodiment. When using either of the supporting means embodiments just disclosed, the lateral drawbar angling forces on the connecting assembly will be greatly reduced. This will aid in protecting the connecting assembly components from pre-mature wear, thereby increasing their operational lives.

The foregoing details have been provided to describe the best mode of the invention and further variations and modifications my be made without departing from the spirit and scope of the invention, which is defined in the following claims.

We claim:

1. In a railcar connector assembly which includes a coupler member, a wedge member, a pocket casting member having an end wall and a pocket forward of said end wall, and a follower block member, said connector assembly having a longitudinal axis and undergoing tensile and compressive loading along said axis, said wedge member having a first fully seated position and a second fully seated position, said first fully seated position defining a first wedge location wherein said wedge is longitudinally aligned with and in simultaneous contact with said follower block and said pocket casting end wall as said connector assembly undergoes tensile loading, said second fully seated position defining a second wedge location wherein said wedge is again longitudinally aligned with and in simultaneous contact with said follower block and said pocket casting end wall as said connector assembly undergoes compressive loading, said wedge comprising:

a front wall; a back wall; a top end; a bottom end; at least two bore openings in each of said front wall and said back wall, each of said bore openings formed by a back face and walls extending inwardly from the surface of said front wall and said back wall, with a resilient supporting means inserted into each of said bore openings for vertically supporting said wedge at a holding position during tensile loading to eliminate a build-up of forces which could occur within said connector assembly by preventing said wedge from dropping into said first fully seated position during tensile loading, said holding position located above said first fully seated position, the height of each of said resilient means and the depth of each of said bore openings being such that said resilient means extends from the surface surrounding the bore opening by about 0.125 inch when uncompressed and the relative volume of each of said resilient means and the volume of each of said bore openings is such that each of the resilient means almost fills the bore opening when fully compressed.

2. The wedge of claim 1 wherein said holding position is defined as a vertical position above said first fully seated position such that a controlled gap is simultaneously maintained between said wedge front wall and said follower block and said back wall and said pocket end wall.

3. The wedge of claim 2 wherein said wedge supporting means is repeatably capable of compressing when said connector assembly undergoes compressive loading, thereby eliminating said controlled gap and preventing said wedge from dropping into said fully seated position.

4. The wedge of claim 3 wherein said wedge supporting means is comprised of a spring assembly.

5. The wedge of claim 4 wherein said wedge supporting means will fully compress when said connector assembly experiences compressive loads between 20,000 and 40,000 pounds per square inch.

6. The wedge of claim 5 wherein said spring assembly is attached to said wedge by inserting said spring assembly within at least one blind bore longitudinally formed within each of said wedge front and back walls, said blind bore having a bore inlet, a bore base, and bore walls having a longitudinal extent defined by the distance between said inlet and said base, said bore having a complementary geometrical shape to said spring assembly such that said spring assembly tightly engages said bore walls.

7. The wedge of claim 6 wherein said spring assembly is comprised of an elastomeric spring secured within said blind bore, said elastomeric spring extending beyond said wedge front and back wall by an amount which is equal to said controlled gap, each said front and back wedge walls having at least one blind bore and said elastomeric spring supporting means.

8. The wedge of claim 3 wherein said wedge supporting means is repeatably capable of restoring said wedge to said holding position after said compressive load is released from said connector assembly, thereby re-establishing said controlled gap.

* * * * *

UNITED STATES PATENT AND TRADEMARK OFFICE

CERTIFICATE OF CORRECTION

PATENT NO. : 5,573,126

DATED : November 12, 1996

INVENTOR(S) : Richard G. Beauclerc, Charles P. Spencer, Franklin S. McKeown, Jr.

It is certified that error appears in the above-identified patent and that said Letters Patent is hereby corrected as shown below:

In column 8, line 42 (claim 5, line 4) delete "per square inch".

Signed and Sealed this

Twenty-fourth Day of June, 1997

Bruce Lehman

*Attest:*

BRUCE LEHMAN

*Attesting Officer*

*Commissioner of Patents and Trademarks*